US012225981B2

(12) United States Patent
Bartels et al.

(10) Patent No.: US 12,225,981 B2
(45) **Date of Patent: *Feb. 18, 2025**

(54) STRAP SYSTEM FOR AN ARTICLE OF FOOTWEAR

(71) Applicant: Nike, Inc., Beaverton, OR (US)

(72) Inventors: Rita M. Bartels, Gresham, OR (US); Shivam Bhan, Hillsboro, OR (US); Holly Harris, Beaverton, OR (US); Eric Joseph Marshall, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/325,728

(22) Filed: May 30, 2023

(65) Prior Publication Data

US 2023/0301393 A1 Sep. 28, 2023

Related U.S. Application Data

(63) Continuation of application No. 16/942,136, filed on Jul. 29, 2020, now Pat. No. 11,700,907.

(60) Provisional application No. 62/880,360, filed on Jul. 30, 2019.

(51) Int. Cl.

| | |
|---|---|
| ***A43B 7/20*** | (2006.01) |
| ***A43B 1/00*** | (2006.01) |
| ***A43C 11/14*** | (2006.01) |

(52) U.S. Cl.

CPC ..... *A43B 7/20* (2013.01); *A43B 1/0081* (2013.01); *A43C 11/1493* (2013.01)

(58) Field of Classification Search

CPC .... A43B 7/20; A43B 7/22; A43B 5/02; A41D 17/00; A41D 17/005; A41D 17/02; A41D 17/04; A43C 11/1493

See application file for complete search history.

(56) References Cited

U.S. PATENT DOCUMENTS

| | | | | |
|---|---|---|---|---|
| 625,423 A * | 5/1899 | Scriven | ..... | A41B 9/04 2/401 |
| 3,327,410 A | 6/1967 | Park, Sr. et al. | | |
| 3,506,000 A | 4/1970 | Baker | | |

(Continued)

FOREIGN PATENT DOCUMENTS

| | | |
|---|---|---|
| DE | 102015017003 A1 | 7/2016 |
| EP | 1616495 A1 | 1/2006 |

OTHER PUBLICATIONS

European Patent Office (ISA), International Search Report and Written Opinion for PCT Application No. PCT/US2020/044027, dated Nov. 6, 2020.

*Primary Examiner* — Megan E Lynch

(74) *Attorney, Agent, or Firm* — Bookoff McAndrews, PLLC.

(57) ABSTRACT

An article of footwear includes a strap system having a medial strap, a lateral strap, and a heel strap. The medial strap extends from a proximal end to a distal end selectively attachable to the upper at the lateral side. The lateral strap extends from a proximal end to a distal end selectively attachable to the upper at the medial side. The heel strap has a proximal portion fixed at the heel region and a distal portion selectively attachable to the upper by a heel strap fastener. The strap fastener is operable to attach one of the distal end of the medial strap and the distal end of the lateral strap to the heel strap.

20 Claims, 8 Drawing Sheets

(56) References Cited

U.S. PATENT DOCUMENTS 3,912,973 A * 10/1975 Young ..... A43B 7/36 361/223
4,577,419 A * 3/1986 Chassaing ..... A43C 11/1493 36/114
4,621,648 A * 11/1986 Ivany ..... A43C 11/1493 602/65
4,640,025 A * 2/1987 DeRenzo ..... A43C 11/1493 36/114
4,729,370 A 3/1988 Kallassy
4,844,058 A * 7/1989 Vogelbach ..... A61F 13/066 602/27
4,962,768 A * 10/1990 Stromgren ..... A61F 13/066 602/27
5,400,529 A * 3/1995 Bell ..... A61F 5/0195 36/114
5,694,703 A * 12/1997 Diaz ..... A43B 3/163 36/7.7
5,704,140 A * 1/1998 Fields ..... A43B 7/1495 36/132
D397,797 S 9/1998 Chiang
5,819,439 A * 10/1998 Sanchez ..... A43B 7/1495 36/89
5,822,887 A * 10/1998 Turner ..... A61F 13/066 36/89
6,126,627 A 10/2000 Brennan
6,272,772 B1 * 8/2001 Sherman ..... A43C 11/14 36/89
D455,836 S * 4/2002 Lammers ..... D24/192
D475,789 S 6/2003 McCormick et al.
D482,792 S 11/2003 McCormick et al.
6,929,617 B2 * 8/2005 McCormick ..... A61F 5/0111 602/65
D515,217 S 2/2006 Machin et al.
7,013,586 B1 * 3/2006 Hatfield ..... A43B 7/20 36/89
7,380,354 B2 * 6/2008 Yamashita ..... A43C 11/1493 36/89
7,845,094 B1 * 12/2010 Gaskins, Jr. ..... A43C 15/00 36/11.5
7,908,771 B2 * 3/2011 Foxen ..... A43B 5/18 602/65
D638,950 S 5/2011 Janzon
D665,914 S 8/2012 Chiang
8,689,469 B2 4/2014 Foxen et al.
9,119,436 B1 9/2015 Ardell et al.
9,402,437 B2 8/2016 Berns et al.
9,591,890 B2 * 3/2017 Too-a-Foo ..... A43B 11/00
9,596,904 B2 3/2017 Bishop et al.
9,675,490 B2 6/2017 Maloney et al.
9,826,795 B2 11/2017 Foxen et al.
9,907,363 B2 3/2018 Smith et al.
10,441,451 B2 * 10/2019 Ostergard ..... A43B 7/20
2005/0268493 A1 * 12/2005 Foxen ..... A43B 3/242 36/89
2006/0005432 A1 * 1/2006 Kassai ..... A43B 11/00 36/138
2006/0101667 A1 5/2006 Kane
2007/0033836 A1 * 2/2007 Rasmussen ..... A43B 1/0081 36/50.1
2009/0071037 A1 * 3/2009 Foxen ..... A43B 7/20 36/89
2009/0192428 A1 7/2009 Deboer et al.
2012/0079746 A1 4/2012 Ferreira et al.
2012/0255194 A1 * 10/2012 Schwartz ..... A61F 5/0127 36/19.5
2014/0005585 A1 * 1/2014 Berns ..... A61F 13/622 602/27
2015/0223554 A1 8/2015 Ardell et al.
2016/0309844 A1 * 10/2016 Smith ..... A43B 3/126
2017/0079827 A1 * 3/2017 Ostergard ..... A61F 5/0111
2018/0242692 A1 * 8/2018 Houng ..... A43C 11/1493
2018/0289099 A1 * 10/2018 Bell ..... A43C 11/1493
2018/0289100 A1 * 10/2018 Bell ..... A43B 3/126
2019/0183209 A1 * 6/2019 Wong ..... A43B 7/14

* cited by examiner

STRAP SYSTEM FOR AN ARTICLE OF FOOTWEAR

CROSS REFERENCE TO RELATED APPLICATIONS

This application is a continuation of U.S. application Ser. No. 16/942,136, filed Jul. 29, 2020, which claims priority under 35 U.S.C. § 119 (e) to U.S. Application No. 62/880,360, filed Jul. 30, 2019, each of which is incorporated by reference herein in its entirety.

FIELD

The present disclosure relates generally to an article of footwear and more particularly to a strap system for an article of footwear.

BACKGROUND

This section provides background information related to the present disclosure which is not necessarily prior art.

Athletes frequently perform lateral movements during the course of a game or practice. For example, American football players perform lateral movements when cutting to evade a defender or make a break on a pass. In so doing, the athlete subjects their ankle to a high degree of stress and rotation.

Conventional footwear is designed to support an athlete's ankle during use in an effort to mitigate the forces experienced by the ankle and reduce the likelihood of injury caused by lateral movements. For example, conventional footwear designed for American football typically includes an upper that extends above a wearer's ankle to allow the material of the upper to extend above and wrap around the wearer's ankle.

While conventional footwear provides support to an athlete's ankle during use, many athletes wrap the exterior of the upper with tape to provide additional support. For example, athletic tape is typically wrapped around an outer surface of an upper in the area of the ankle and usually extends around the upper and under the foot of the wearer at an outsole of the footwear. This practice is commonly referred to as "spatting" and provides an extra degree of support during use.

Conventional spatting serves its intended purpose but not without several drawbacks. First, conventional spatting is not reusable and often leaves unwanted residue on an outer surface of the footwear upper. Second, once spatting is attached to the upper, it is not easily adjustable and, therefore, cannot easily be adjusted for fit without starting from scratch with new athletic tape. Finally, even if a desired fit is achieved, often many layers of tape are required to provide adequate support, which is time consuming to apply and, in some instances, may interfere with ground-engaging elements (i.e., cleats) of the footwear when wrapped around the outsole.

BRIEF DESCRIPTION OF DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
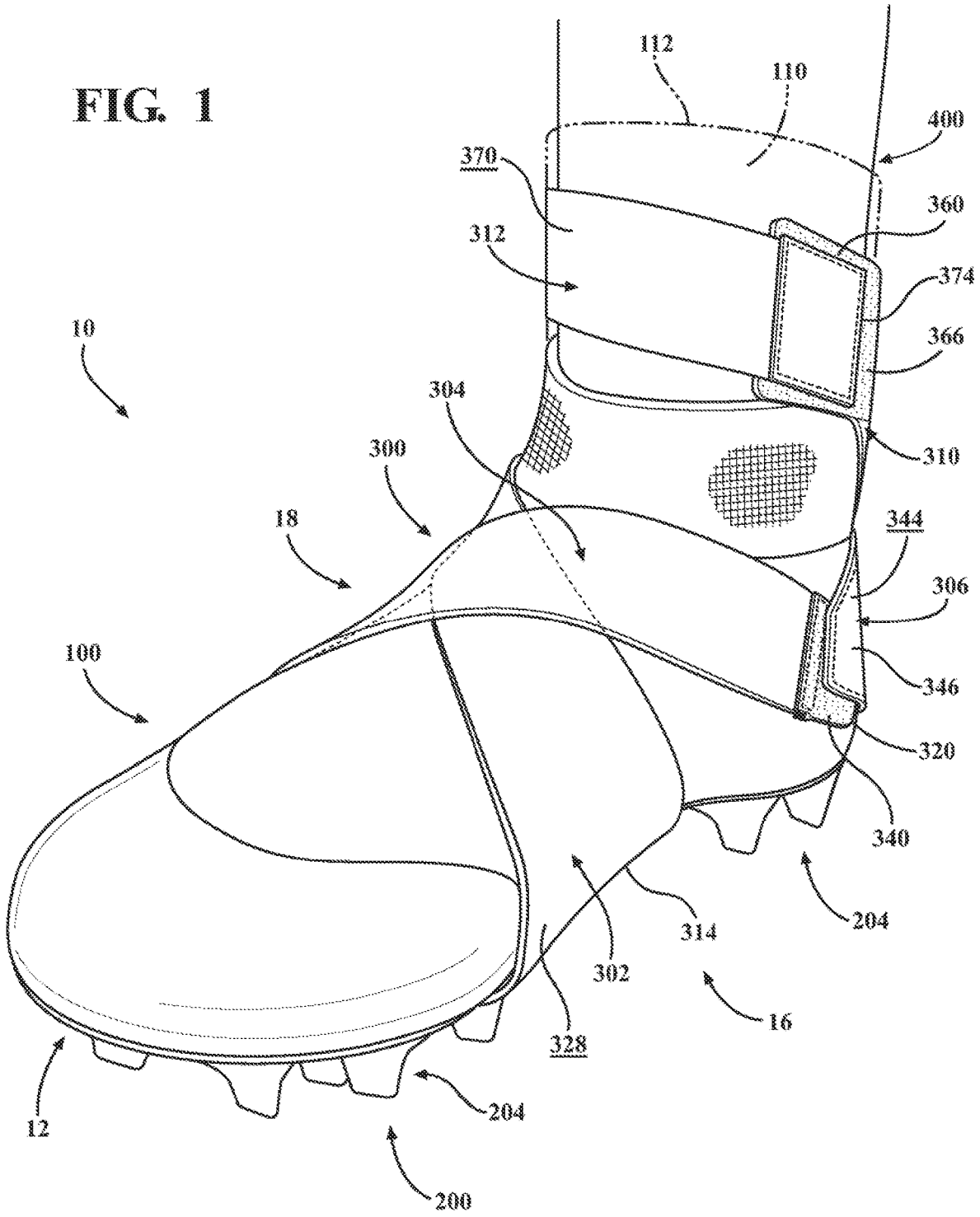
FIG. 1 is a perspective view of an article of footwear including a first strap in an attached state, a second strap in an attached state, a heel strap in an attached state, and a support strap in an attached state, in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an article of footwear having a medial side and a lateral side is provided and includes an upper, a first strap extending from a proximal end fixed at the medial side to a first distal end selectively attachable to the upper at the lateral side, and a second strap extending from a proximal end fixed at the lateral side to a second distal end selectively attachable to the upper at the medial side. A heel strap is also provided and includes a first portion fixed at a heel region and a second portion selectively attachable to the upper by a first fastener, the first fastener operable to attach one of the first distal end of the first strap and the second distal end of the second strap to the heel strap.

The one of the first distal end of the first strap and the second distal end of the second strap may be disposed between the heel strap and the upper when attached to the upper and the first fastener. Further, the other of the first distal end of the first strap and the second distal end of the second strap may be operable to be attached to the first fastener. Further yet, the first distal end of the first strap may be attached to the first fastener at the lateral side and the second distal end of the second strap may be attached to the first fastener at the medial side.

The first distal end of the first strap may include a second fastener and a third fastener disposed on an opposite side of the first strap than the second fastener, the second fastener may be operable to attach the first strap to the upper and the third fastener may be operable to attach the first strap to the first fastener. The second distal end of the second strap may include a fourth fastener and a fifth fastener disposed on an opposite side of the second strap than the fourth fastener, the fourth fastener may be operable to attach the second strap to the upper and the fifth fastener may be operable to attach the second strap to the first fastener. At least one of the first fastener, the second fastener, the third fastener, the fourth fastener, and the fifth fastener may be a hook-and-loop fastener.

In one configuration, the first strap may cross the second strap at an instep region of the upper when the first strap is attached to the lateral side of the upper and the second strap is attached to the medial side of the upper.

A support strap may be attached to the heel strap and may be operable to wrap around an ankle region of a wearer during use. The support strap may extend from the heel strap at an opposite end of the heel strap than the first portion.

In another configuration, an article of footwear having a medial side and a lateral side is provided and includes an upper, a first strap extending from a proximal end fixed at the medial side to a first distal end selectively attachable to the upper at the lateral side in an attached state, and a second strap extending from a proximal end fixed at the lateral side to a second distal end selectively attachable to the upper at the medial side in an attached state. A heel strap is also provided and includes a first portion fixed at a heel region and a second portion selectively attachable to the upper by a first fastener in an attached state, at least one of the first distal end of the first strap and the second distal end of the second strap disposed between the heel strap and the upper in the attached state of the heel strap and the attached state of the at least one of the first distal end of the first strap and the second distal end of the second strap.

The first fastener may be attached to the upper and a second fastener may be attached to the second portion of the heel strap and may oppose the first fastener when the heel strap is attached to the upper. The second fastener may be operable to attach the at least one of the first distal end of the first strap and the second distal end of the second strap to the heel strap. The other of the first distal end of the first strap and the second distal end of the second strap may be operable to be attached to the first fastener. The first distal end of the first strap may be attached to the first fastener at the lateral side and the second distal end of the second strap may be attached to the first fastener at the medial side.

In one configuration, the first distal end of the first strap may include a third fastener and a fourth fastener disposed on an opposite side of the first strap than the third fastener, the third fastener may be operable to attach the first strap to the first fastener and the fourth fastener may be operable to attach the first strap to the second fastener. Further, the second distal end of the second strap may include a fifth fastener and a sixth fastener disposed on an opposite side of the second strap than the fifth fastener, the fifth fastener may be operable to attach the second strap to the first fastener and the sixth fastener may be operable to attach the second strap to the second fastener.

At least one of the first fastener, the second fastener, the third fastener, the fourth fastener, the fifth fastener, and the sixth fastener may be a hook-and-loop fastener.

The first strap may cross the second strap at an instep region of the upper when the first strap is attached to the lateral side of the upper and the second strap is attached to the medial side of the upper. A support strap may be attached to the heel strap and may be operable to wrap around an ankle region of a wearer during use.

The support strap may extend from the heel strap at an opposite end of the heel strap than the first portion.

Figure 2:
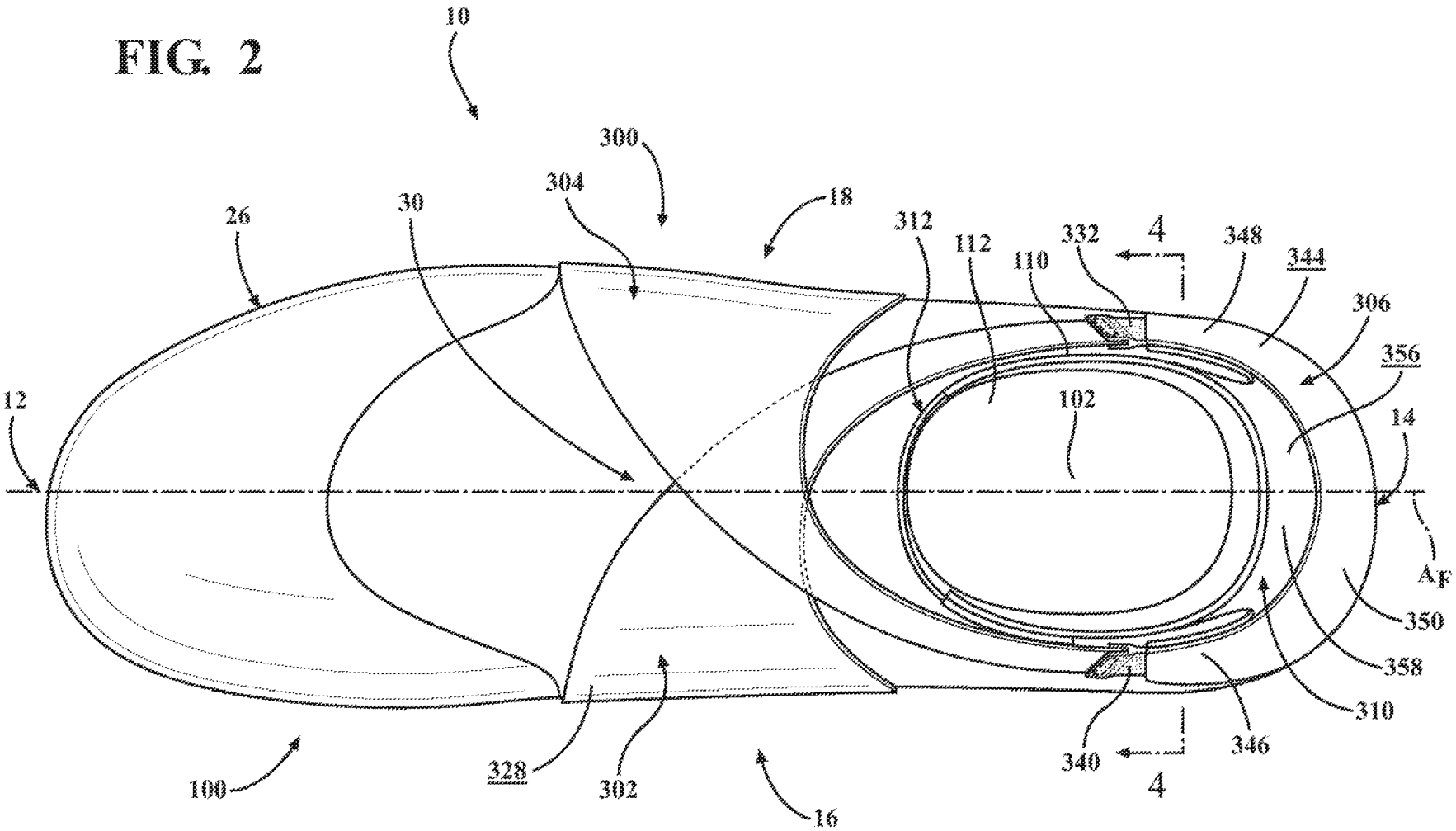
FIG. 2 is a top view of the article of footwear of FIG. 1.
Figure 3:
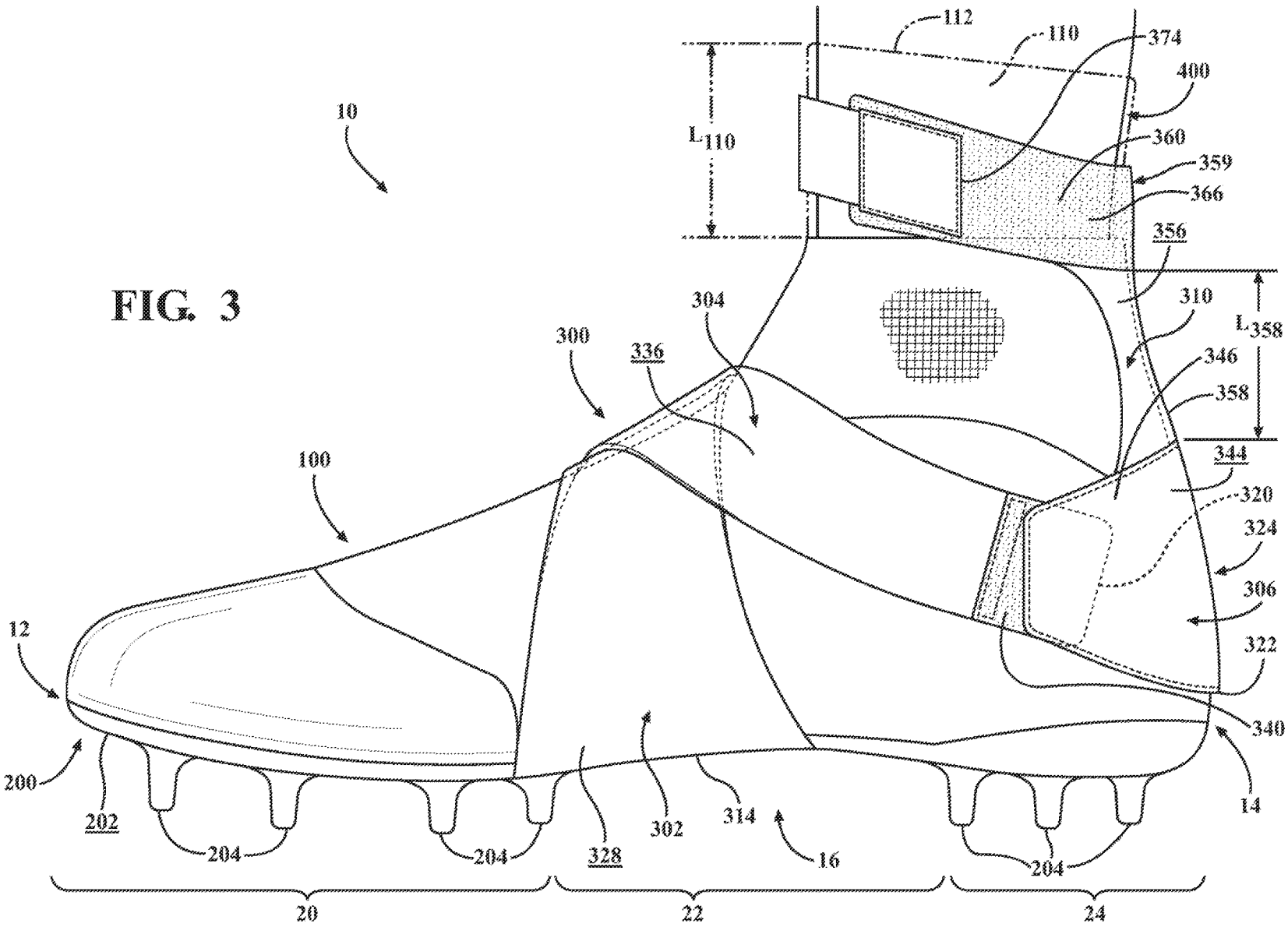
FIG. 3 is a side view of the article of footwear of FIG. 1.

Referring to FIG. 1, an article of footwear 10 is provided and includes an upper 100, a sole structure 200 attached to the upper, and a strap system 300 configured to wrap around the upper 100 and the sole structure 200 to provide supplemental support to the article of footwear 10. The article of footwear 10 may further include an anterior end 12 associated with a forward-most point of the footwear 10, and a posterior end 14 corresponding to a rearward-most point of the article of footwear 10. As shown in FIG. 2, a longitudinal axis $A_F$ of the article of footwear 10 extends along a length of the article of footwear 10 from the anterior end 12 to the posterior end 14 parallel to a ground surface, and generally divides the article of footwear 10 into a medial side 16 and a lateral side 18. Accordingly, the medial side 16 and the lateral side 18 respectively correspond with opposite sides of the article of footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18. As shown in FIG. 3, the article of footwear 10 may be divided into one or more regions. The regions may include a forefoot region 20, a midfoot region 22, and a heel region 24. While the article of footwear 10 described herein and shown in the figures refers generally to an article of footwear 10 corresponding to a right foot of a wearer, it should be understood that the article of footwear 10 may similarly correspond to a left foot of a wearer.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 4:
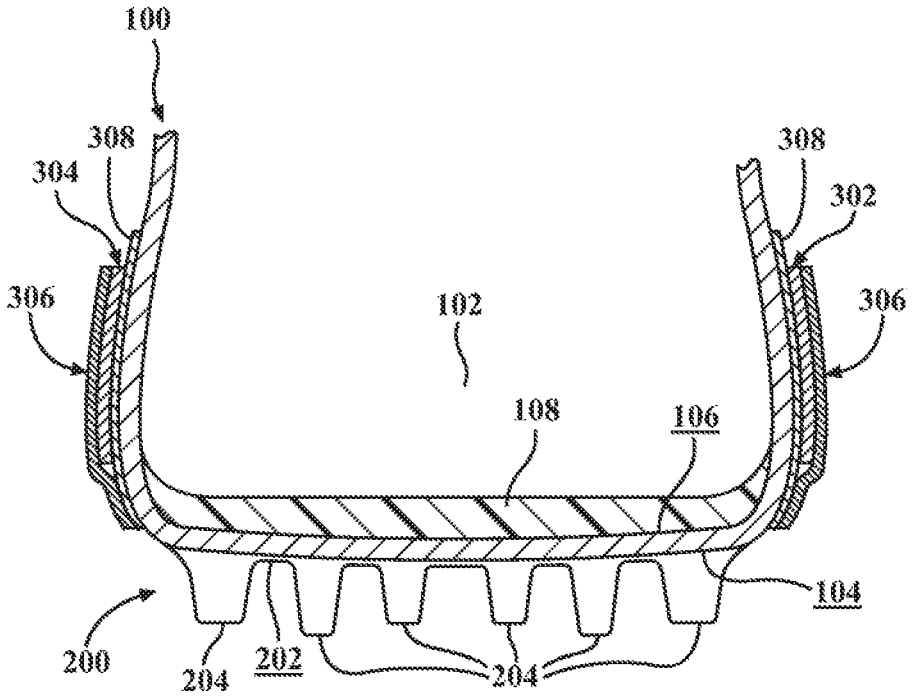
FIG. 4 is a cross-sectional view of the article of footwear of FIG. 1 taken along line 4-4 of FIG. 2.

With reference to FIG. 4, in some examples, the upper 100 includes a bottom surface 104 or a strobel opposing the sole structure 200 and an opposing top surface 106 defining a footbed 106 of the interior void 102. Stitching or adhesives may secure the bottom surface 104 to the upper 100. The footbed 106 may be contoured to conform to a profile of a bottom surface (e.g., plantar) of the foot. Optionally, the upper 100 may also incorporate additional layers such as an insole 108 or sockliner that may be disposed upon the footbed 106 and reside within the interior void 102 of the upper 100 to receive a plantar surface of the foot to enhance the comfort of the article of footwear 10.

The upper 100 includes a collar 110 formed in the heel region 24, which defines an ankle opening 112 for providing access to the interior void 102. For example, the ankle opening 112 may receive a foot to secure the foot within the void 102 and to facilitate entry and removal of the foot to and from the interior void 102. As shown, a length $L_{110}$ of the collar 110 is selected depending on a desired configuration of the strap system 300. For example, in some configurations the collar 110 may be a mid-cut collar, where the length $L_{110}$ of the collar 110 extends to or just above the ankle. Here, the strap system 300 may be configured to wrap above the collar 110, and directly around the leg of the wearer. In other examples, the collar 110 may be a high-cut collar (shown in phantom line), where the length $L_{110}$ of the collar extends beyond the ankle to a lower portion of the leg. In this example, the strap system 300 may wrap around an exterior surface of the collar 110. Where a high-cut collar 110 is used, the exterior surface of the collar may be formed of or coated with a material having a relatively high-coefficient of friction to prevent slippage of the strap system 300 relative to the collar 110.

In some examples, one or more fasteners (not shown) extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners. The fasteners may include laces, straps, cords, hook-and-loop, or any other suitable type of fastener. The upper 100 may include a tongue portion (not shown) that extends between the interior void 102 and the fasteners.

In some configurations, the sole structure 200 is configured to provide traction for the article of footwear 10. In addition to providing traction, the sole structure 200 may attenuate ground reaction forces when compressed between the foot and the ground during walking, running, or other ambulatory activities. The sole structure 200 extends between the upper 100 and the ground when the article of footwear 10 is worn. In different configurations, the sole structure 200 may include different components. For example, the sole structure 200 may include an outsole, a midsole, and/or the insole 108. In some implementations, one or more of these components are optional.

The sole structure 200 may be constructed of a lightweight and flexible material. In some configurations, the sole structure 200 may be constructed of a plastic material. For example, the sole structure 200 may be constructed of a plastic molding, including, but not limited to, a thermoplastic elastomer, a thermoplastic polyurethane (TPU), or carbon fiber.

In some implementations, the sole structure 200 is configured according to one or more types of ground surfaces on which the sole structure 200 may be used. Examples of ground surfaces include, but are not limited to, natural turf, synthetic turf, dirt, natural grass, as well as other surfaces. In some configurations, the sole structure 200 is provided with a plurality of traction elements 204 disposed on and extending from the bottom surface 202 of the sole structure 200. The traction elements 204 may include, cleats, studs, projections, treads, or any combination thereof depending on the particular use of the article of footwear 10 and the ground surface on which the traction elements 204 will engage. Typically, traction elements 204 may be configured for American football, soccer, baseball, or any type of activity that requires traction with a ground surface.

Referring to the figures, generally, the article of footwear 10 includes a strap system 300, which may also be referred to as a spatting system. The strap system 300 includes a medial strap 302, a lateral strap 304, and a heel strap 306. The medial strap 302 and the lateral strap 304 may also be referred to as a first strap and a second strap, respectively. The medial strap 302 extends from a proximal end 314 fixed at the medial side 16 to a distal end 316 selectively attachable to the upper 100 at the lateral side 18. The lateral strap 304 extends from a proximal end 318 fixed at the lateral side 18 to a distal end 320 selectively attachable to the upper 100 at the medial side 16. The heel strap 306 has a proximal portion 322 fixed at the heel region 24 and a distal portion 324 selectively attachable to the upper 100 by a heel strap fastener 352. The proximal portion 322 of the heel strap 306 and the distal portion 324 of the heel strap 306 may also be referred to as a first portion and a second portion, respectively. The strap fastener 352 is operable to attach one of the distal end 316 of the medial strap 302 and the distal end 320 of the lateral strap 304 to the heel strap 306.

The strap system 300 may be attached to at least one of the upper 100 and the sole structure 200, or the strap system 300 may be integrally formed with at least one of the upper 100 and the sole structure 200. The strap system 300 may provide support for an ankle of a wearer during use of the article of footwear 10. Specifically, the medial strap 302, the lateral strap 304, and the heel strap 306 may cooperate to wrap around portions of a foot and an ankle and provide compression and support to the foot and the ankle, thereby limiting excessive transverse and/or rotational movement of the ankle relative to a ground surface during use.

Figure 5:
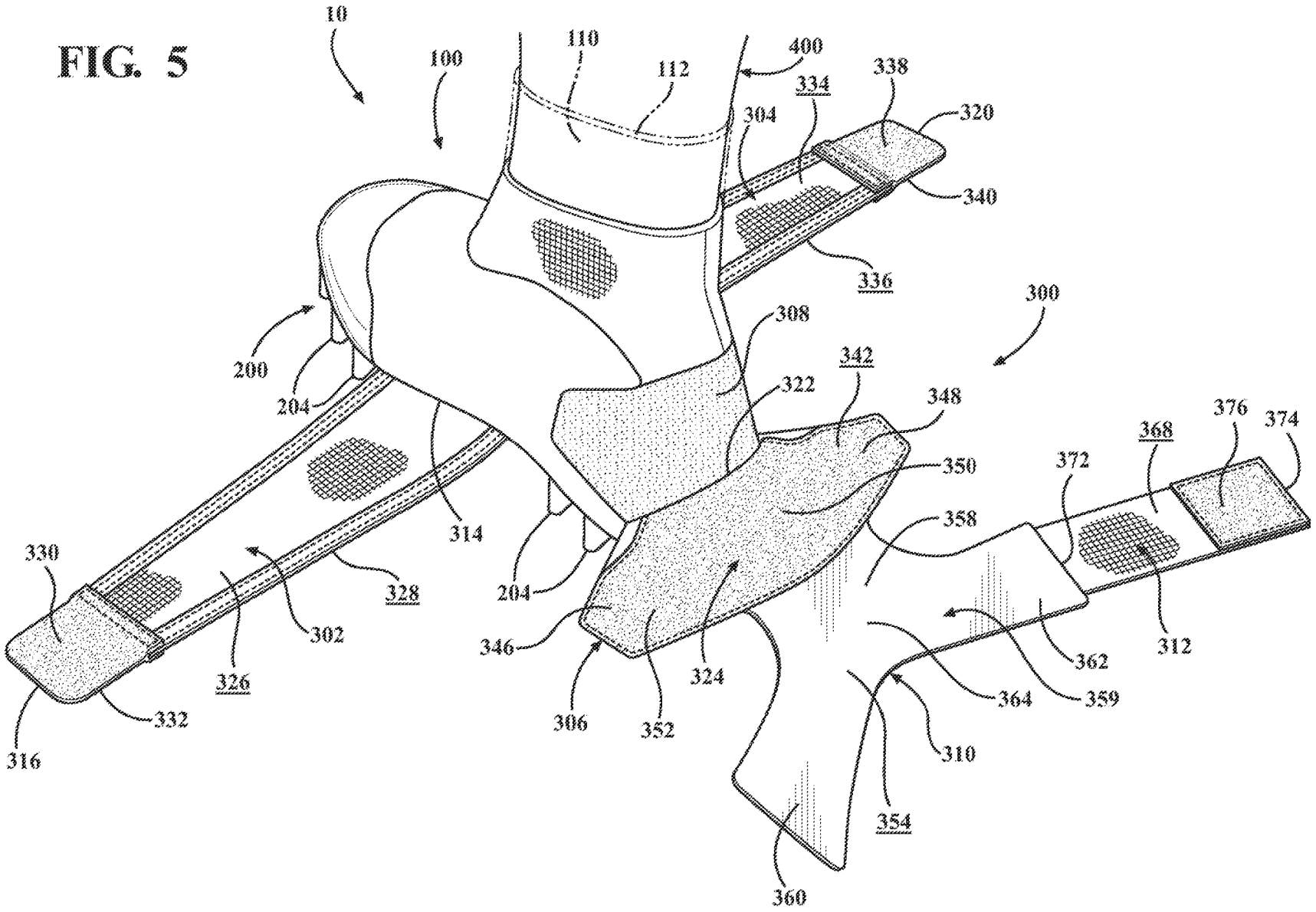
FIG. 5 is a rear perspective view of the article of footwear of FIG. 1 with the first strap in an unattached state, the second strap in an unattached state, the heel strap in an unattached state, and the support strap in an unattached state.
Figure 6:
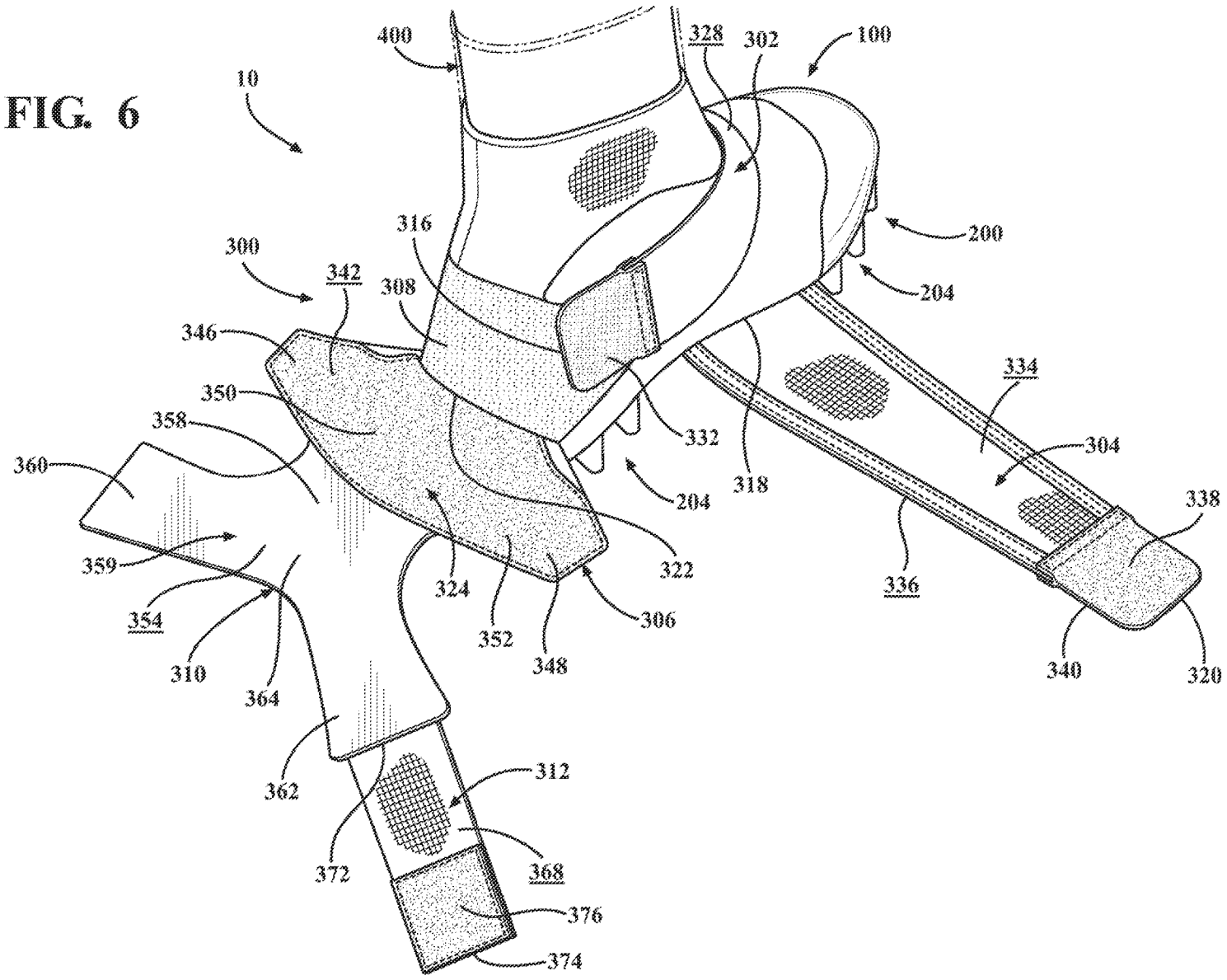
FIG. 6 is a rear perspective view of the article of footwear of FIG. 1 with the first strap in an attached state, the second strap in an unattached state, the heel strap in an unattached state, and the support strap in an unattached state.
Figure 7:
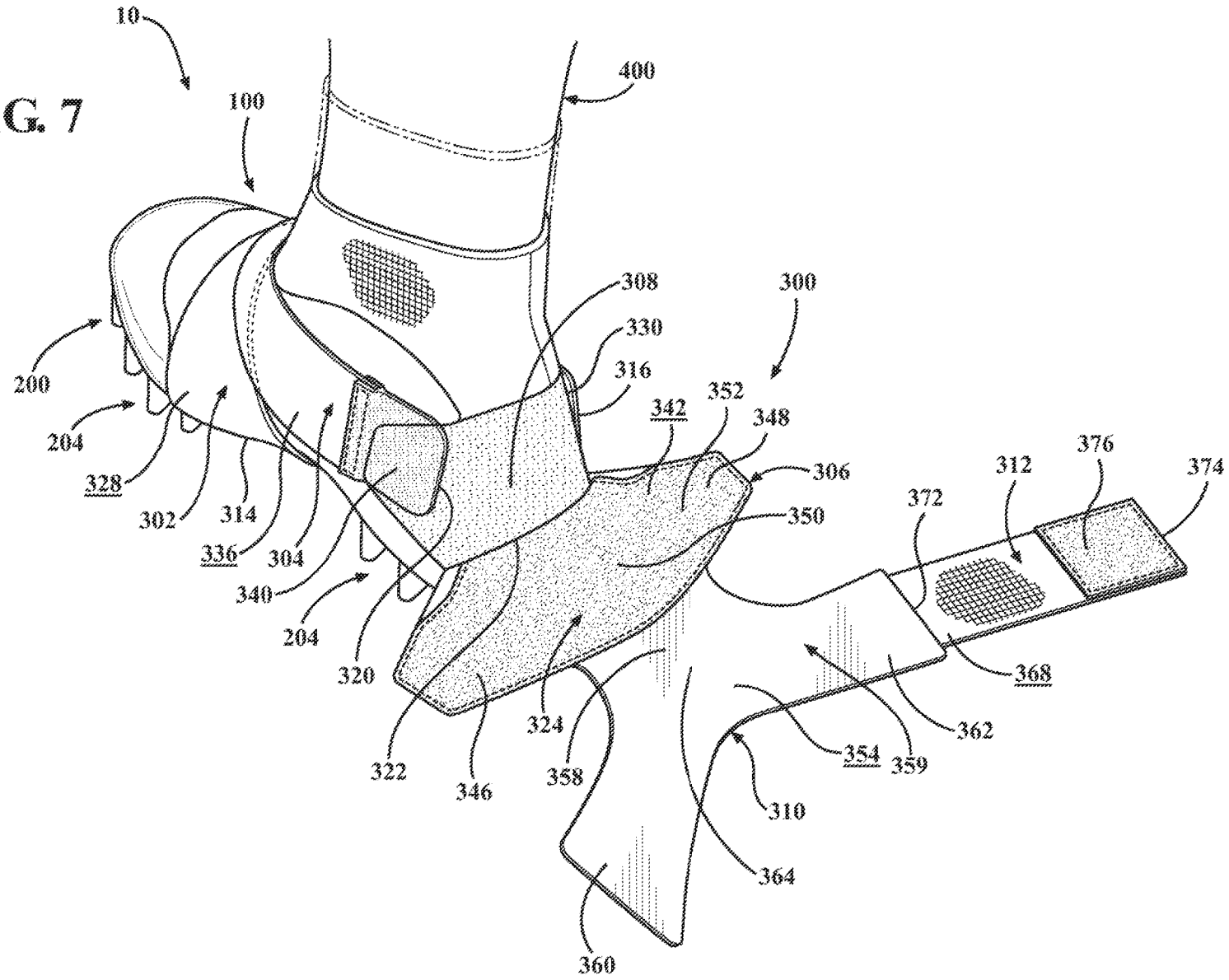
FIG. 7 is a rear perspective view of the article of footwear of FIG. 1 with the first strap in an attached state, the second strap in an attached state, the heel strap in an unattached state, and the support strap in an unattached state.

With reference to FIGS. 5-7, the strap system 300 additionally includes a heel region fastener 308 that is in selective engagement with the medial strap 302, the lateral strap 304, and the heel strap 306, as will be described in more detail below. In some implementations, the heel region fastener 308 is fixed to the upper 100 via stitching, adhesive, welding, mechanical fasteners, or any other suitable means. In other implementations, the heel region fastener 308 is integrally formed with the upper 100. The heel region fastener 308 may generally be disposed on the heel region 24 of the upper 100 and may extend into and be disposed on both the medial side 16 and the lateral side 18. As such, the heel region fastener 308 may wrap around the heel region 24 and extend from the medial side 16 to the lateral side 18.

With reference to FIGS. 5 and 6, the medial strap 302 is operable between an unattached state (FIG. 5) and an attached state (FIG. 6) relative to the upper 100. The medial strap 302 includes an inner surface 326 facing the upper 100 in the attached state and an outer surface 328 facing away from the upper 100 in the attached state. The medial strap 302 extends from the proximal end 314 to the distal end 316. In some implementations, the proximal end 314 is fixed to the upper 100 at the medial side 16. In other implementations, the proximal end 314 is fixed to the sole structure 200 at the medial side 16. In other implementations, the proximal end 314 is fixed to both the upper 100 and the sole structure 200 at the medial side 16. The proximal end 314 may be fixed to one of the upper 100 and the sole structure 200 at or near the midfoot region 22, (e.g., along a peripheral region 26 at or near the midfoot region 22). The proximal end 314 may be fixed to one of the upper 100 and the sole structure 200 via stitching, adhesive, welding, mechanical fasteners, or any other suitable means. The medial strap 302 additionally includes an inner fastener 330 and an outer fastener 332 disposed on an opposite side of the medial strap 302 than the inner fastener 330 and located proximate to or at the distal end 316. That is, the inner fastener 330 may be disposed on or adjacent to the inner surface 326 of the medial strap 302 and the outer fastener 332 may be disposed on or adjacent to the outer surface 328 of the medial strap 302. As will become apparent, the inner fastener 330 may selectively attach the medial strap 302 to the upper 100 (i.e., at the heel region fastener 308 at the lateral side 18) and the outer fastener 332 may selectively attach the medial strap 302 to the heel strap 306.

With reference to FIGS. 6 and 7, the lateral strap 304 is operable between an unattached state (FIG. 6) and an attached state (FIG. 7) relative to the upper 100. The lateral strap 304 includes an inner surface 334 facing the upper 100 in the attached state and an outer surface 336 facing away from the upper 100 in the attached state. The lateral strap 304 extends from the proximal end 318 to the distal end 320. In some implementations, the proximal end 318 is fixed to the upper 100 at the lateral side 18. In other implementations, the proximal end 318 is fixed to the sole structure 200 at the lateral side 18. In other implementations, the proximal end 318 is fixed to both the upper 100 and the sole structure 200 at the lateral side 18. The proximal end 318 may be fixed to one of the upper 100 and the sole structure 200 at or near the midfoot region 22 (e.g., along the peripheral region 26 at or near the midfoot region 22). The proximal end 318 may be fixed to one of the upper 100 and the sole structure 200 via stitching, adhesive, welding, mechanical fasteners, or any other suitable means. The lateral strap 304 additionally includes an inner fastener 338 and an outer fastener 340 disposed on an opposite side of the lateral strap 304 than the inner fastener 338 and located proximate to or at the distal end 320. That is, the inner fastener 338 may be disposed on or adjacent to the inner surface 334 of the lateral strap 304 and the outer fastener 340 may be disposed on or adjacent to the outer surface 336 of the lateral strap 304. As will become apparent, the inner fastener 338 may selectively attach the lateral strap 304 to the upper 100 (i.e., at the heel region fastener 308 at the medial side 16) and the outer fastener 340 may selectively attach the lateral strap 304 to the heel strap 306.

The medial strap 302 and the lateral strap 304 may be formed of the same material(s), different material(s), or any suitable combination. In some implementations, the medial strap 302 and the lateral strap 304 may be at least partially formed of a material having generally elastic properties, such as, for example, elastane, rubber, etc. In other implementations, the medial strap 302 and the lateral strap 304 may be at least partially formed of a material having generally inelastic properties, such as, for example, leather, synthetic leather, nylon, etc. The outer surface 328 of the medial strap 302 and/or the outer surface 336 of the lateral strap 304 may be coated with a material to provide the strap(s) 302, 304 with a desired characteristic. For example, one or both of the medial strap 302 and the lateral strap 304 may include a coating that provides the strap(s) 302, 304 with increased durability, friction, rigidity, resistance to wear, hydrophobicity, etc.

With reference to FIGS. 5-8, the heel strap 306 is operable between an unattached state (FIGS. 5-7) and an attached state (FIG. 8) relative to the upper 100. The heel strap 306 includes an inner surface 342 facing the upper 100 in the attached state and an outer surface 344 facing away from the upper 100 in the attached state. The heel strap 306 extends from the proximal portion 322 to the distal portion 324. In some implementations, the proximal portion 322 is fixed to the upper 100 at or near the posterior end 14. In other implementations, the proximal portion 322 is fixed to the sole structure 200 at or near the posterior end 14. In other implementations, the proximal portion 322 is fixed to both the upper 100 and the sole structure 200 at or near the posterior end 14. The proximal end 318 may be fixed to one of the upper 100 and the sole structure 200 at or near the heel region 24 (e.g., along the peripheral region 26 at or near the heel region 24). The proximal portion 322 may be fixed to one of the upper 100 and the sole structure 200 via stitching, adhesive, welding, mechanical fasteners, or any other suitable means. At or near the distal portion 324, the heel strap 306 includes the heel strap fastener 352 disposed on or adjacent to the inner surface 342 of the heel strap 306. As will become apparent, the heel strap fastener 352 may selectively attach the heel strap 306 to (i) the outer fastener 332 of the medial strap 302, (ii) the outer fastener 340 of the lateral strap 304, and/or (iii) the upper 100 (i.e., the heel region fastener 308).

In the attached state, the heel strap 306 may extend into and be disposed on both the medial side 16 and the lateral side 18 such that the heel strap 306 wraps around the heel region 24. For example, the heel strap 306 may include a medial portion 346, a lateral portion 348, and a central portion 350 extending from the medial portion 346 to the lateral portion 348. In the attached state, the medial portion 346 may be disposed on the medial side 16, the lateral portion 348 may be disposed on the lateral side 18, and the central portion 350 may wrap around the heel region 24 from the medial side 16 to the lateral side 18. As shown in FIGS. 5-7, in some implementations, the heel strap 306 and the heel region fastener 308 have similar corresponding shapes. In other implementations, the heel strap 306 and the heel region fastener 308 have different shapes.

In some implementations, the heel strap 306 may be at least partially formed of a material having generally elastic properties, such as, for example, elastane, rubber, etc. In other implementations, the heel strap 306 may be at least partially formed of a material having generally inelastic properties, such as, for example, leather, synthetic leather, nylon, etc. The outer surface 344 of the heel strap 306 may be coated with a material to impart certain characteristics to the heel strap 306 such as, for example, increased durability, rigidity, resistance to wear, hydrophobicity, etc.

Figure 8:
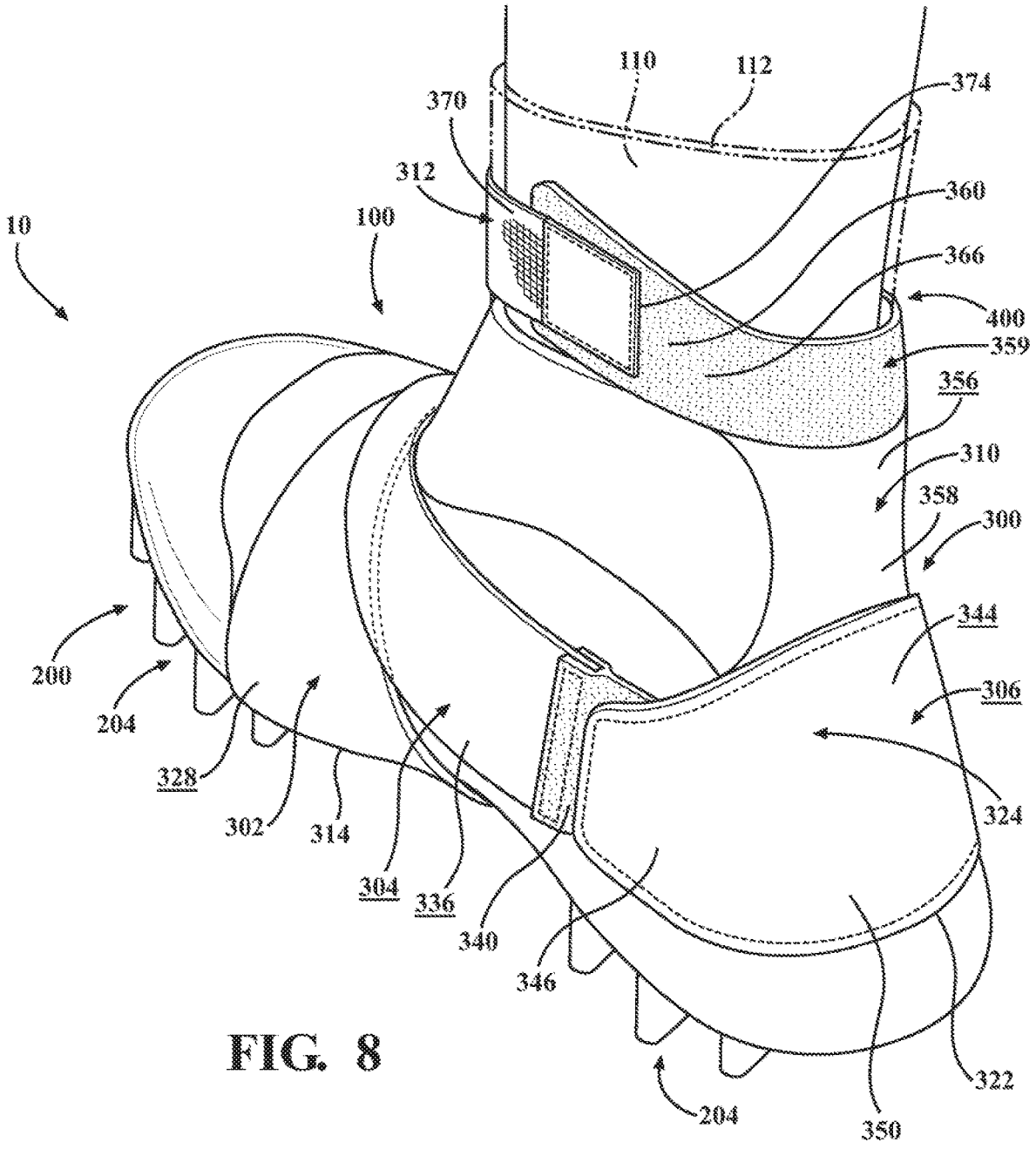
FIG. 8 is a rear perspective view of the article of footwear of FIG. 1.

With reference to FIGS. 5-8, the strap system 300 may include an Achilles strap 310 and a support strap 312. The support strap 312 may be operable between an unattached state (FIG. 5) and an attached state (FIG. 8). The Achilles strap 310 includes an inner surface 354 facing the upper 100 when the support strap 312 is in the attached state and an outer surface 356 facing away from the upper 100 when the support strap 312 is in the attached state. The Achilles strap 310 extends from a proximal portion 358 attached to the upper 100 distal portion 359, which may be described as including a medial portion 360, a lateral portion 362, and a central portion 364 extending between the medial portion 360 and the lateral portion 362. For example, the Achilles strap 310 may have a generally Y-shaped configuration. In some implementations, the proximal portion 358 is fixed to the heel strap 306 (e.g., the distal portion 324 of the heel strap 306) at or near the posterior end 14. In other implementations, the proximal portion 358 is fixed to at least one of the upper 100 and the sole structure 200 at or near the posterior end 14. In other implementations, the Achilles strap 310 is integrally formed with the heel strap 306. The proximal portion 358 may be fixed to one of the heel strap 306, the upper 100, and the sole structure 200 via stitching, adhesive, welding, mechanical fasteners, or any other suitable means. The Achilles strap 310 additionally includes a first ankle fastener 366 (FIGS. 3 and 8) disposed on or adjacent to the outer surface 356 of the Achilles strap 310. In other implementations, the first ankle fastener 366 is disposed at or near the medial portion 360 and extends into the central portion 364. As set forth above, the support strap 312 may be operable between the unattached state and the attached state. In the attached state, the support strap 312 may wrap around an ankle region 400 of a wearer during use. The support strap 312 includes an inner surface 368 facing the ankle region 400 or lower leg of the wearer in the attached state and an outer surface 370 facing away from the ankle region 400 or the lower leg of the wearer in the attached state. The support strap 312 extends from a proximal end 372 to a distal end 374. In some implementations, the proximal end 372 is fixed to the Achilles strap 310 at or near the lateral portion 362. In other implementations, the support strap 312 is disposed at or near the medial portion 360 and the first ankle fastener 366 is disposed at or near the lateral portion 362. Regardless of the particular location of the support strap 312 relative to the Achilles strap 310, the support strap 312 may be integrally formed with the Achilles strap 310. Further, the Achilles strap 310 may be integrally formed with both the heel strap 306 and the support strap 312. The proximal end 372 may be fixed to the Achilles strap 310 via stitching, adhesive, welding, mechanical fasteners, or any other suitable means. The support strap 312 may include a second ankle fastener 376 disposed on or adjacent to the inner surface 368 of the support strap 312 at or near the distal end 374. As will become apparent, the second ankle fastener 376 may selectively attach the support strap 312 to the Achilles strap 310 (i.e., at the first ankle fastener 366).

Each of the fasteners (i.e., the inner fastener 330 and the outer fastener 332 of the medial strap 302, the inner fastener 338 and the outer fastener 340 of the lateral strap 304, the heel strap fastener 352, the heel region fastener 308, the first ankle fastener 366 of the Achilles strap 310, and the second ankle fastener 376 of the support strap 312) may be a hook-and-loop fastener. That is, each of the fasteners may attach to a corresponding other of the fasteners via a hook-and-loop arrangement. As one example, the inner fastener 330 of the medial strap 302 may include a hook fastener arrangement and the heel region fastener 308 may include a loop fastener arrangement that engages the hook fastener arrangement of the inner fastener 330. As another example, the heel region fastener 308 may include a hook fastener arrangement and the inner fastener 330 of the medial strap 302 may include a loop fastener arrangement that engages the hook fastener arrangement of the heel region fastener 308. The foregoing examples may generally apply to each of the other fasteners (i.e., the outer fastener 332 of the medial strap 302 and the heel strap fastener 352, the inner fastener 338 of the lateral strap 304 and the heel region fastener 308, the outer fastener 340 of the lateral strap 304 and the heel strap fastener 352, the heel strap fastener 352 and the heel region fastener 308, and the first ankle fastener 366 and the second ankle fastener 376). Alternatively, the fasteners may be attached to each other by any suitable selectively releasable fastener, such as, for example, snaps, buttons, magnets, etc.

With reference to FIGS. 5-8, the strap system 300 is operable between an unattached state (FIG. 5), a partially attached state (FIGS. 6 and 7), and an attached state (FIGS. 1-3 and 8). To move the strap system 300 from the unattached state to the attached state, a wearer may first move the medial strap 302 toward the heel region 24 over an instep region 30, crossing the longitudinal axis $A_F$, and attach the medial strap 302 to the upper 100 by attaching the inner fastener 330 of the medial strap 302 to the heel region fastener 308 at the lateral side 18, as shown in FIG. 6. Next, the wearer may first move the lateral strap 304 toward the heel region 24 over the instep region 30, crossing the longitudinal axis $A_F$, and attach the lateral strap 304 to the upper 100 by attaching the inner fastener 338 of the lateral strap 304 to the heel region fastener 308 at the medial side 16, as shown in FIG. 7. In other implementations, the wearer first moves the lateral strap 304 and then moves the medial strap 302. When the medial strap 302 and the lateral strap 304 are both in the attached state, the medial strap 302 crosses the lateral strap 304 at the instep region 30 of the upper 100. For example, a portion of the medial strap 302 between the proximal end 314 and the distal end 316 may contact a portion of the lateral strap 304 between the proximal end 318 and the distal end 320 proximate to or at the instep region 30 of the upper 100.

Next, the wearer moves the heel strap 306 toward the upper 100 by rotating the heel strap 306 about the proximal portion 322 fixed to the upper 100. The heel strap 306 is attached to the upper 100 by attaching the heel strap fastener 352 to the heel region fastener 308. The heel strap 306 is also attached to the medial strap 302 and the lateral strap 304 by the heel strap fastener 352 attaching to the outer fastener 332 of the medial strap 302 and the outer fastener 340 of the lateral strap 304. As shown in FIG. 4, the medial strap 302 (e.g., the distal end 316 of the medial strap 302) may be disposed between the heel strap 306 and the upper 100 and the lateral strap 304 (e.g., the distal end 320 of the lateral strap 304) may be disposed between the heel strap 306 and the upper 100. Finally, the Achilles strap 310 is moved toward the ankle region 400 of the wearer by rotating the Achilles strap 310 about the proximal portion 358 fixed to the heel strap 306. The medial portion 360 and the lateral portion 362 may be partially wrapped around the ankle region 400 or the lower leg of the wearer. The support strap 312 may then be wrapped around the remaining portion of the ankle region 400 and attached to the Achilles strap 310 by attaching the second ankle fastener 376 to the first ankle fastener 366.

As discussed above, the length $L_{110}$ of the collar 110 may be selected depending on a desired configuration of the strap 300. For example, a mid-cut length $L_{110}$ of the collar 110 may be selected so that the Achilles strap 310 and the support strap 312 wrap directly around an ankle region 400 of the wearer, or a high-cut length $L_{110}$ (phantom) may be selected so that the Achilles strap 310 and the support strap 312 wrap around the collar 110. Additionally or alternatively, a length of the Achilles strap 310 may be selected based on a desired configuration of the strap system 300. Particularly, a length $L_{358}$ of the proximal portion of the Achilles strap 310 may be selected depending on whether the support strap 312 will wrap directly around the ankle region 400 or around the collar 110.

One or more of the straps 302, 304, 306, 308, 310 may be provided with non-slip surfaces to prevent slipping of the straps 302, 304, 306, 308, 310 relative to each other and the article of footwear. For example, the inner surfaces and/or the outer surfaces may be formed of or coated with a high-friction material. In some examples, the high-friction material is applied to the straps using a screen-printing process, and may be localized along the surfaces of the straps 302, 304, 306, 308, 310. For example, a strip of the high-friction material may extend continuously from one end of a strap to another, and may have a width that is less than a width of the strap. In other examples, the high-friction material may be provided in patches or zones on the surfaces of the straps 302, 304, 306, 308, 310.

When the strap system 300 is in the attached state (FIGS. 1-3 and 8), the strap system 300 provides the article of footwear 10 and, thus, an ankle of a wearer, with increased support. Further, the strap system 300 allows a wearer to easily adjust a fit of the footwear 10 around the foot by adjusting a position of the strap system 300 relative to the upper 100. Finally, the strap system 300 is reusable and may be used each time the footwear 10 is worn by the wearer without having to remove or replace any of the components associated with the strap system 300.

The following Clauses provide an exemplary configuration for an article of footwear described above.

Clause 1: An article of footwear having a medial side and a lateral side, the article of footwear including: an upper; a first strap extending from a proximal end fixed at the medial side to a first distal end selectively attachable to the upper at the lateral side; a second strap extending from a proximal end fixed at the lateral side to a second distal end selectively attachable to the upper at the medial side; and a heel strap having a first portion fixed at a heel region and a second portion selectively attachable to the upper by a first fastener, the first fastener operable to attach one of the first distal end of the first strap and the second distal end of the second strap to the heel strap.

Clause 2: The article of footwear of Clause 1, wherein the one of the first distal end of the first strap and the second distal end of the second strap is disposed between the heel strap and the upper when attached to the upper and the first fastener.

Clause 3: The article of footwear of Clause 2, wherein the other of the first distal end of the first strap and the second distal end of the second strap is operable to be attached to the first fastener.

Clause 4: The article of footwear of Clause 3, wherein the first distal end of the first strap is attached to the first fastener at the lateral side and the second distal end of the second strap is attached to the first fastener at the medial side.

Clause 5: The article of footwear of Clause 4, wherein the first distal end of the first strap includes a second fastener and a third fastener disposed on an opposite side of the first strap than the second fastener, the second fastener operable to attach the first strap to the upper and the third fastener operable to attach the first strap to the first fastener.

Clause 6: The article of footwear of Clause 5, wherein the second distal end of the second strap includes a fourth fastener and a fifth fastener disposed on an opposite side of the second strap than the fourth fastener, the fourth fastener operable to attach the second strap to the upper and the fifth fastener operable to attach the second strap to the first fastener.

Clause 7: The article of footwear of Clause 6, wherein at least one of the first fastener, the second fastener, the third fastener, the fourth fastener, and the fifth fastener is a hook-and-loop fastener.

Clause 8: The article of footwear of any of the preceding Clauses, wherein the first strap crosses the second strap at an instep region of the upper when the first strap is attached to the lateral side of the upper and the second strap is attached to the medial side of the upper.

Clause 9: The article of footwear of any of the preceding Clauses, further comprising a support strap attached to the heel strap and operable to wrap around an ankle region of a wearer during use.

Clause 10: The article of footwear of Clause 9, wherein the support strap extends from the heel strap at an opposite end of the heel strap than the first portion.

Clause 11: An article of footwear having a medial side and a lateral side, the article of footwear including: an upper; a first strap extending from a proximal end fixed at the medial side to a first distal end selectively attachable to the upper at the lateral side in an attached state; a second strap extending from a proximal end fixed at the lateral side to a second distal end selectively attachable to the upper at the medial side in an attached state; and a heel strap having a first portion fixed at a heel region and a second portion selectively attachable to the upper by a first fastener in an attached state, at least one of the first distal end of the first strap and the second distal end of the second strap disposed between the heel strap and the upper in the attached state of the heel strap and the attached state of the at least one of the first distal end of the first strap and the second distal end of the second strap.

Clause 12: The article of footwear of Clause 11, wherein the first fastener is attached to the upper and a second fastener is attached to the second portion of the heel strap and opposes the first fastener when the heel strap is attached to the upper, the second fastener operable to attach the at least one of the first distal end of the first strap and the second distal end of the second strap to the heel strap.

Clause 13: The article of footwear of Clause 12, wherein the other of the first distal end of the first strap and the second distal end of the second strap is operable to be attached to the first fastener.

Clause 14: The article of footwear of Clause 13, wherein the first distal end of the first strap is attached to the first fastener at the lateral side and the second distal end of the second strap is attached to the first fastener at the medial side.

Clause 15: The article of footwear of Clause 14, wherein the first distal end of the first strap includes a third fastener and a fourth fastener disposed on an opposite side of the first strap than the third fastener, the third fastener operable to attach the first strap to the first fastener and the fourth fastener operable to attach the first strap to the second fastener.

Clause 16: The article of footwear of Clause 15, wherein the second distal end of the second strap includes a fifth fastener and a sixth fastener disposed on an opposite side of the second strap than the fifth fastener, the fifth fastener operable to attach the second strap to the first fastener and the sixth fastener operable to attach the second strap to the second fastener.

Clause 17: The article of footwear of Clause 16, wherein at least one of the first fastener, the second fastener, the third fastener, the fourth fastener, the fifth fastener, and the sixth fastener is a hook-and-loop fastener.

Clause 18: The article of footwear of any of the preceding Clauses, wherein the first strap crosses the second strap at an instep region of the upper when the first strap is attached to the lateral side of the upper and the second strap is attached to the medial side of the upper.

Clause 19: The article of footwear of any of the preceding Clauses, further comprising a support strap attached to the heel strap and operable to wrap around an ankle region of a wearer during use.

Clause 20: The article of footwear of Clause 19, wherein the support strap extends from the heel strap at an opposite end of the heel strap than the first portion.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear having a medial side and a lateral side, the article of footwear comprising:

an upper;

a first strap extending from a proximal end fixed at the medial side to a first distal end selectively attachable to the upper at the lateral side;

a second strap extending from a proximal end fixed at the lateral side to a second distal end selectively attachable to the upper at the medial side;

a heel strap having a first portion permanently fixed to the article of footwear at a heel region, the heel strap permanently fixed along a connecting region that is disposed at a posterior end of the upper, the heel strap permanently fixed from a lateral side of the connecting region disposed on a lateral side of the article of footwear to a medial side of the connecting region disposed on a medial side of the article of footwear and the heel strap including a second portion selectively attachable to the upper; and a support strap, the support strap being coupled to the heel strap and being configured to wrap around an ankle of a wearer of the article of footwear.

2. The article of footwear of claim 1, wherein the heel strap is rotatable about the fixed first portion.

3. The article of footwear of claim 1, wherein the first strap crosses the second strap at an instep region of the upper when the first strap is attached to the lateral side of the upper and the second strap is attached to the medial side of the upper.

4. The article of footwear of claim 1, further including an additional strap operable to wrap around an Achilles region of a wearer during use, wherein the additional strap is disposed between the heel strap and the support strap.

5. The article of footwear of claim 4, further comprising:

the additional strap comprises a first portion directly coupled to the heel strap, a first branch extending directly from the first portion of the additional strap and away from the heel strap, and a second branch extending directly from the first portion of the additional strap and away from the heel strap, and wherein the support strap is coupled directly to the additional strap only at the first branch.

6. The article of footwear of claim 4, wherein the support strap and the additional strap are integral with the upper.

7. The article of footwear of claim 1, wherein the upper includes:

an interior void;

laces, straps, or cords; and a tongue portion extending between the interior void and the laces, straps, or cords.

8. An article of footwear having a medial side and a lateral side, the article of footwear comprising:

an upper; and a heel strap having a first portion permanently fixed to the article of footwear, extending from the lateral side to the medial side, at a heel region of the article of footwear and a second portion selectively attachable to the upper by a first fastener in an attached state, the heel strap rotatable about the first portion, the second portion having a free top end not fixed to the article of footwear:

a support strap coupled directly to the free top end of the second portion of the heel strap, wherein the support strap is integral with the upper and configured to wrap around an ankle of a wearer of the article of footwear.

9. The article of footwear of claim 8, wherein the first fastener is attached to the upper and a second fastener is attached to the second portion of the heel strap and opposes the first fastener when the heel strap is attached to the upper.

10. The article of footwear of claim 9, wherein the first fastener or the second fastener is a hook-and-loop fastener.

11. The article of footwear of claim 8, wherein the upper includes a collar, the collar being formed at a heel region of the article of footwear and defining an ankle opening.

12. The article of footwear of claim 11, wherein the collar is a mid-cut collar or a low-cut collar.

13. The article of footwear of claim 8, further including an additional strap operable to wrap around an Achilles region of a wearer during use, and wherein the additional strap is disposed between the heel strap and the support strap.

14. The article of footwear of claim 13, further comprising:

the additional strap comprises a first portion directly coupled to the heel strap, a first branch extending directly from the first portion and away from the heel strap, and a second branch extending directly from the first portion and away from the heel strap, and wherein the support strap is coupled directly to the additional strap only at the first branch of the additional strap.

15. The article of footwear of claim 14, wherein:

the second branch of the additional strap includes a first ankle fastener;

the support strap extends from a proximal end to a distal end, wherein the proximal end of the support strap is directly coupled to the first branch, and the distal end of the support strap includes a second ankle fastener; and the first ankle fastener and the second ankle fastener are selectively attachable to one another.

16. An article of footwear having a medial side and a lateral side, the article of footwear comprising:

a longitudinal axis and a lateral-medial axis;

an upper;

a heel strap having a first portion permanently fixed at a heel region of the article of footwear along a connecting region extending from the lateral side to the medial side, the heel strap being fixed at the connecting region from the lateral side to the medial side of the article of footwear, and a second portion selectively attachable to the upper by a first fastener, the second portion having a free top end;

an Achilles strap coupled to the heel strap, the Achilles strap having a first portion directly coupled to the free top end of the second portion of the heel strap, and two branches extending from the first portion to form a Y-shape; and a support strap extending from a proximal end and a distal end, the proximal end extending from only a first of the two branches of the Achilles strap, the distal end being configured to selectively attach to the second of the two branches.

17. The article of footwear of claim 16, wherein the heel strap is rotatable about the fixed first portion.

18. The article of footwear of claim 16, wherein the proximal end of the support strap is fixed to the first of the two branches of the Achilles strap.

19. The article of footwear of claim 16, wherein the support strap is operable between an unattached state and an attached state.

20. The article of footwear of claim 16, wherein the Achilles strap is integral with the heel strap or the support strap.

* * * * *